US010153594B2

(12) United States Patent
Wu et al.

(10) Patent No.: US 10,153,594 B2
(45) Date of Patent: Dec. 11, 2018

(54) ELECTRICAL CONNECTOR HAVING ELONGATED HOUSING AND INTERCONNECTED UPPER AND LOWER SHELLS ATTACHED TO THE HOUSING

(71) Applicant: FOXCONN INTERCONNECT TECHNOLOGY LIMITED, Grand Cayman (KY)

(72) Inventors: Jerry Wu, Irvine, CA (US); Yang-Tsun Hsu, New Taipei (TW); Jun Chen, Kunshan (CN); Xiao Fan, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/719,545

(22) Filed: Sep. 28, 2017

(65) Prior Publication Data

US 2018/0097312 A1 Apr. 5, 2018

(30) Foreign Application Priority Data

Sep. 30, 2016 (CN) ..... 2016 1 0865079

(51) Int. Cl.

| | |
|---|---|
| ***H01R 13/6593*** | (2011.01) |
| ***H01R 13/6581*** | (2011.01) |
| ***H01R 9/03*** | (2006.01) |
| ***H01R 24/60*** | (2011.01) |
| ***H01R 12/71*** | (2011.01) |
| ***H01R 13/506*** | (2006.01) |

(Continued)

(52) U.S. Cl.
CPC ..... *H01R 13/6581* (2013.01); *H01R 12/7082* (2013.01); *H01R 12/716* (2013.01); *H01R 12/775* (2013.01); *H01R 13/506* (2013.01); *H01R 13/516* (2013.01); *H01R 24/60* (2013.01); *H01R 2107/00* (2013.01)

(58) Field of Classification Search
CPC .. H01R 12/592; H01R 12/775; H01R 12/707; H01R 12/57; H01R 12/73
See application file for complete search history.

(56) References Cited

U.S. PATENT DOCUMENTS 7,601,029 B2 * 10/2009 Horiuchi ..... H01R 4/20 439/497
8,172,616 B2 * 5/2012 Miyazaki ..... H01R 12/592 439/607.55

(Continued)

FOREIGN PATENT DOCUMENTS

| | | |
|---|---|---|
| CN | 101383469 | 3/2009 |
| CN | 102035100 | 4/2011 |
| TW | 201304316 | 1/2013 |

*Primary Examiner* — Briggitte R Hammond
(74) *Attorney, Agent, or Firm* — Wei Te Chung; Ming Chieh Chang

(57) ABSTRACT

An electrical connector includes: an elongated insulative housing; plural contacts secured to the housing; an upper shell attached to the housing, the upper shell having a latching piece (12) secured to a middle portion of the housing; and a lower shell attached to the housing and connected to the upper shell at both end portions thereof in a longitudinal direction, the lower shell having a protruding piece (22) secured to the middle portion of the housing, wherein the upper shell includes a connecting piece (13) secured to a middle portion of the lower shell.

18 Claims, 7 Drawing Sheets

(51) Int. Cl.

| | |
|---|---|
| ***H01R 12/70*** | (2011.01) |
| ***H01R 12/77*** | (2011.01) |
| ***H01R 13/516*** | (2006.01) |
| *H01R 107/00* | (2006.01) |

(56) References Cited

U.S. PATENT DOCUMENTS 8,287,311 B2 10/2012 Lin et al.
8,801,467 B2 * 8/2014 Lan ..... H01R 12/724
439/607.36

* cited by examiner

ELECTRICAL CONNECTOR HAVING ELONGATED HOUSING AND INTERCONNECTED UPPER AND LOWER SHELLS ATTACHED TO THE HOUSING

BACKGROUND OF THE INVENTION

1. Field of the Invention

The present invention relates to an elongated electrical connector having interconnected upper and lower shells both attached to an elongated insulative housing thereof.

2. Description of Related Art

U.S. Pat. No. 8,172,616 discloses an electrical connector including an elongated insulative housing and upper and lower shells connected to each other at both end portions of the housing. The lower shell has a protruding piece at a middle portion thereof while the upper shell has a receiving portion for receiving the protruding piece. A distal end of the protruding piece is attached to the upper shell by solder through the receiving portion so that the protruding piece is electrically and physically connected to the upper shell.

China Patent No. 101383469 discloses an electrical connector including an elongated insulative housing, a wire retainer, and upper and lower shells interconnected to each other. The lower shell is integral with the housing and has a protruding piece for securing the wire retainer to the housing.

Upper and lower shells of a different structure are desired.

SUMMARY OF THE INVENTION

An electrical connector comprises: an elongated insulative housing; a plurality of contacts secured to the housing; an upper shell attached to the housing, the upper shell having a latching piece secured to a middle portion of the housing; and a lower shell attached to the housing and connected to the upper shell at both end portions thereof in a longitudinal direction, the lower shell having a protruding piece secured to the middle portion of the housing, wherein the upper shell includes a connecting piece secured to a middle portion of the lower shell.

DETAILED DESCRIPTION OF THE PREFERRED EMBODIMENT

Figure 1:
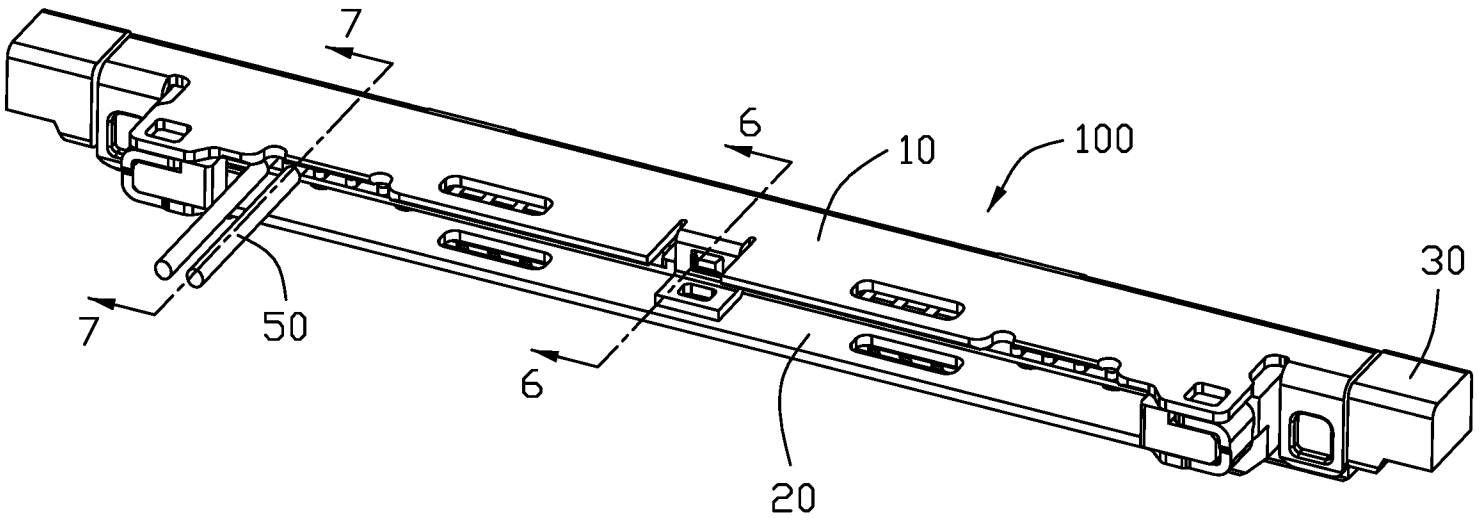
FIG. 1 is a perspective view of an electrical connector in accordance with the present invention.
Figure 2:
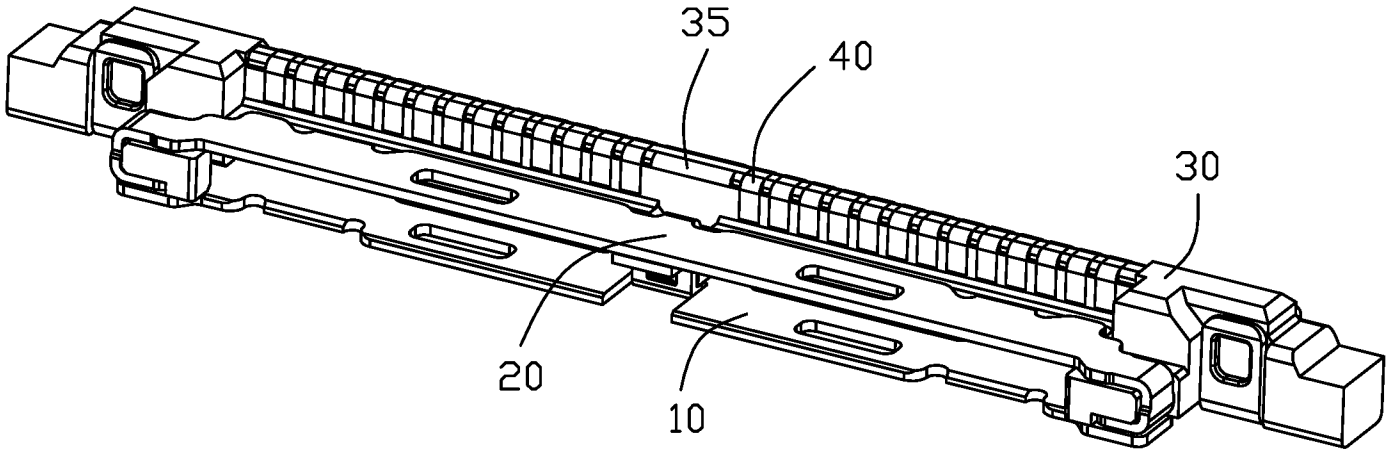
FIG. 2 is a further perspective view of the electrical connector.
Figure 3:
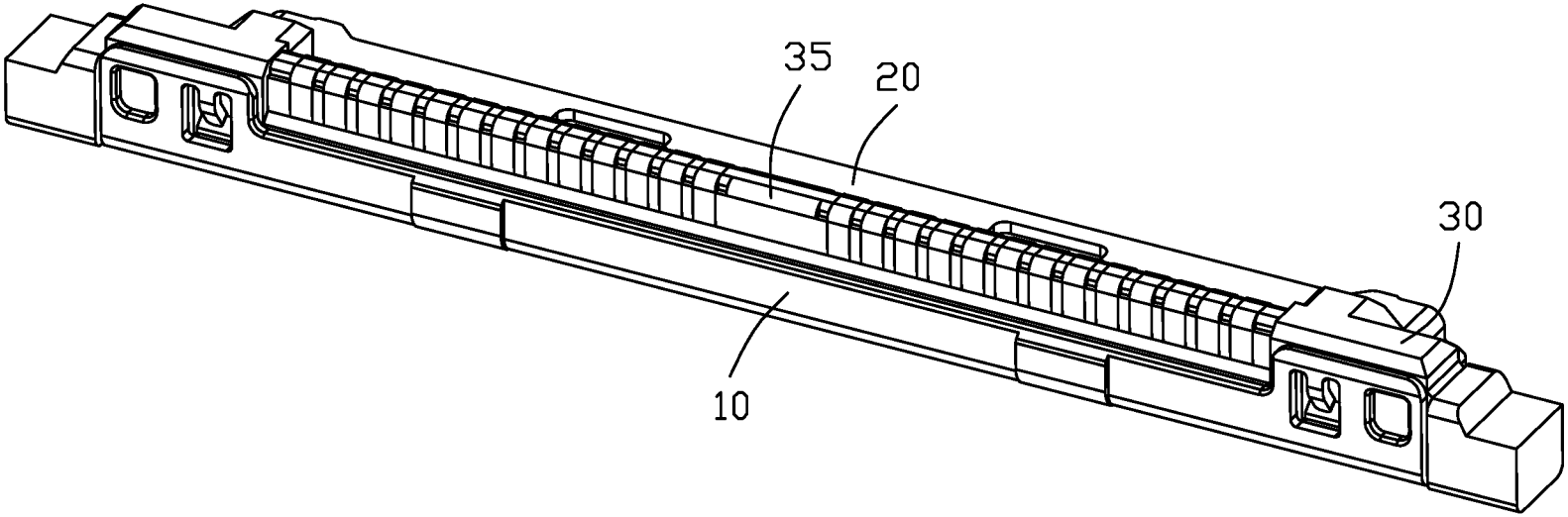
FIG. 3 is another perspective view of the electrical connector.
Figure 4:
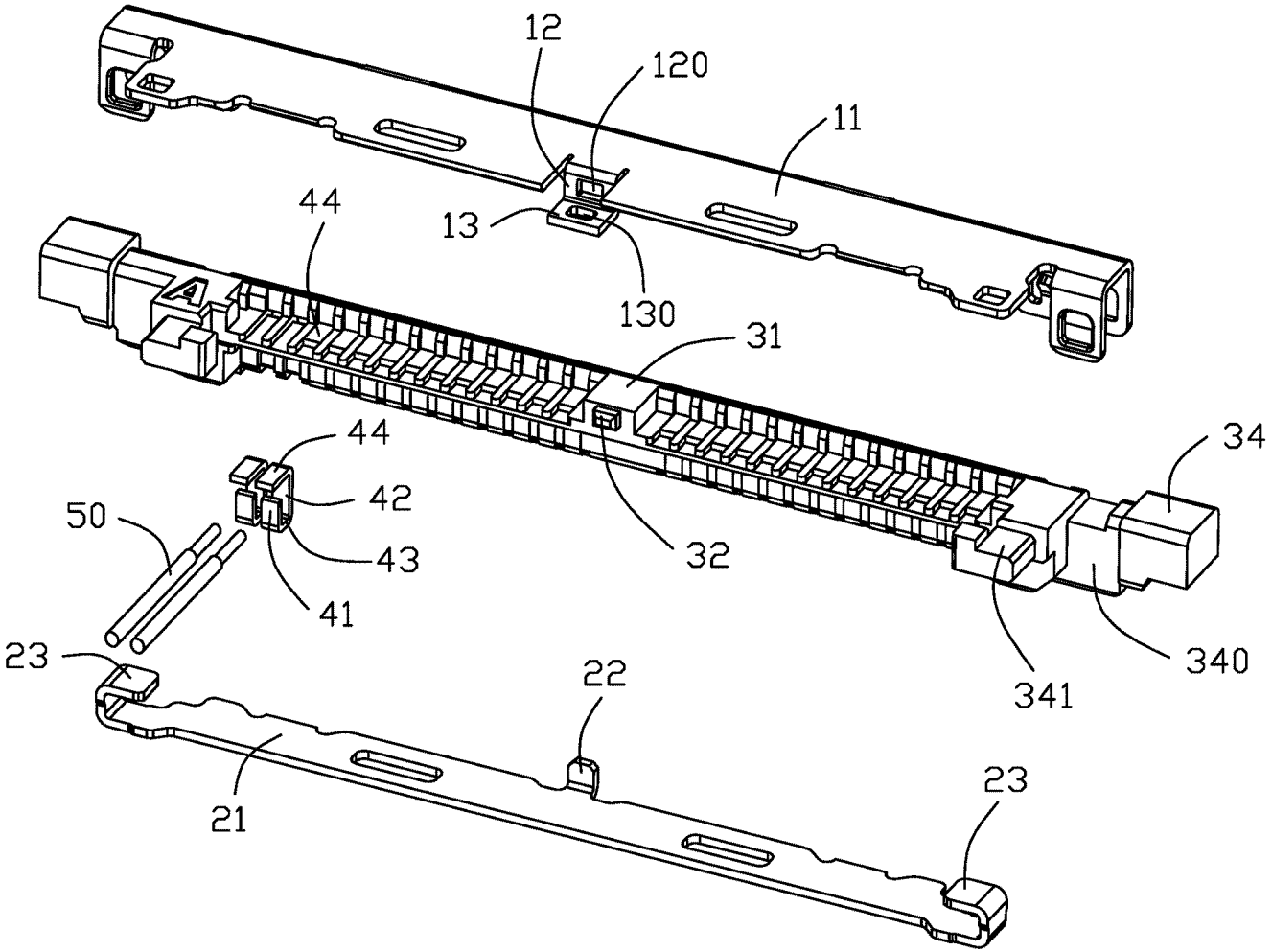
FIG. 4 is an exploded view of the electrical connector.
Figure 5:
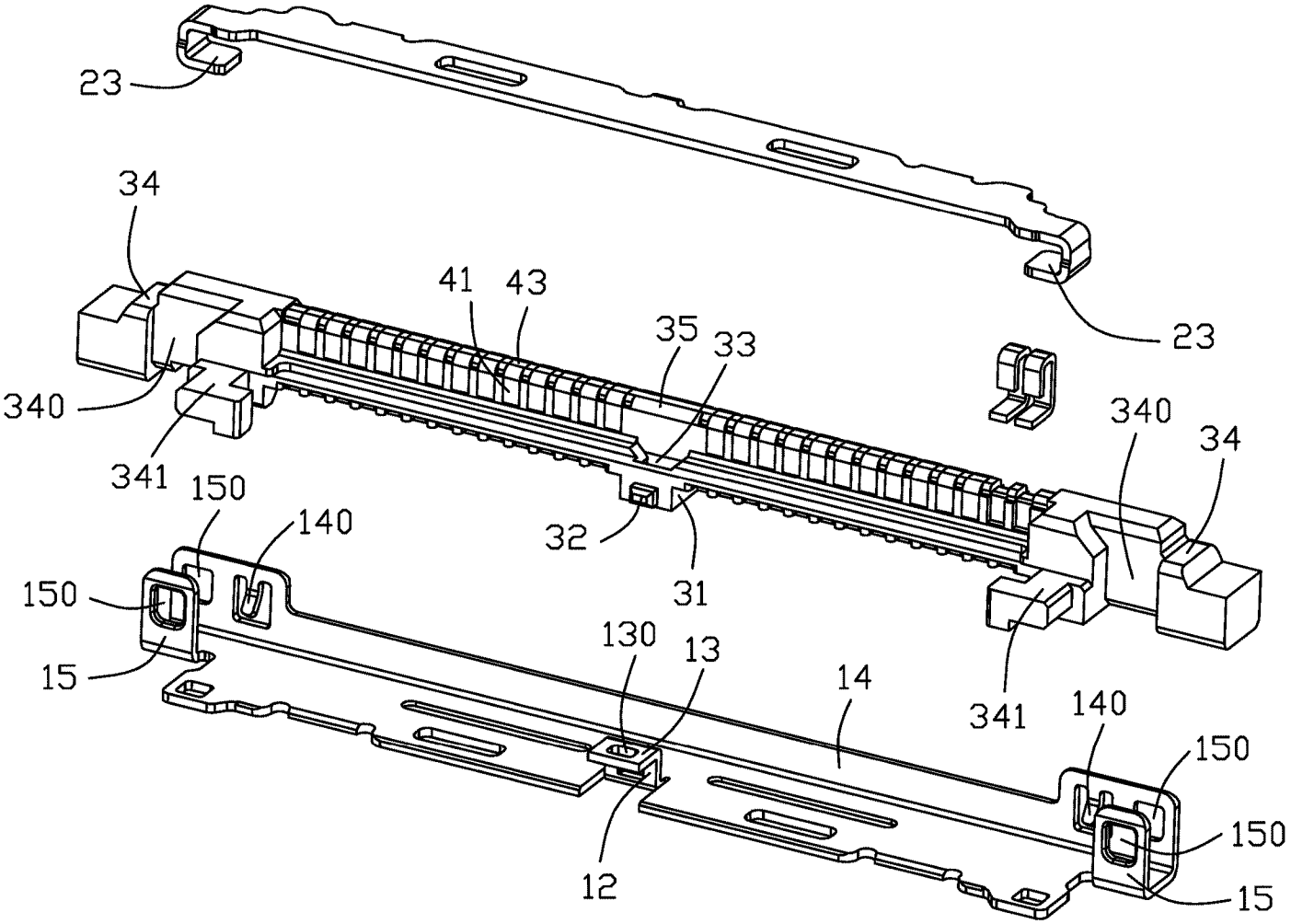
FIG. 5 is another exploded view of the electrical connector.
Figure 6:
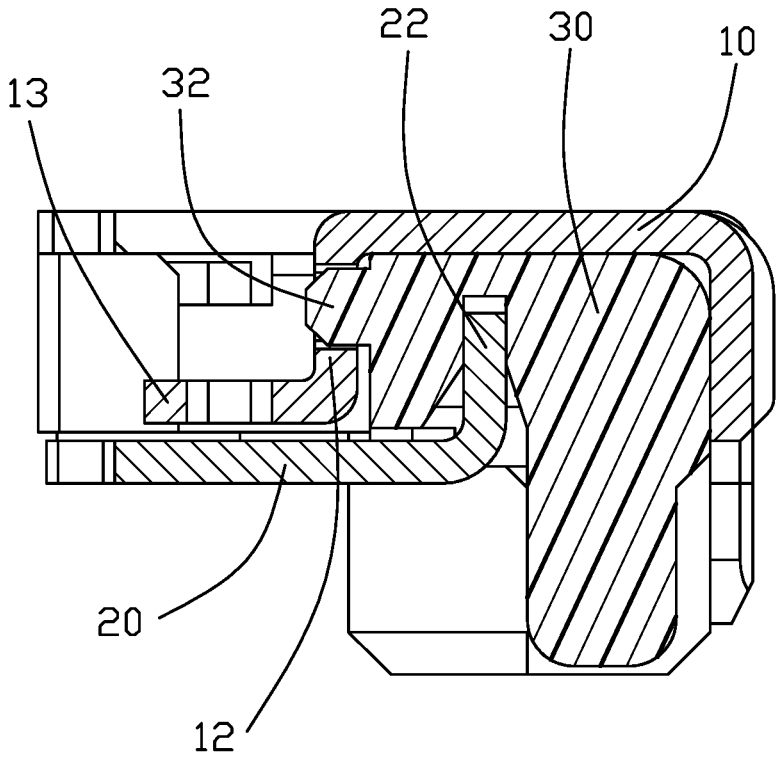
FIG. 6 is a cross-sectional view of the electrical connector to show the relation between the housing and the shell.
Figure 7:
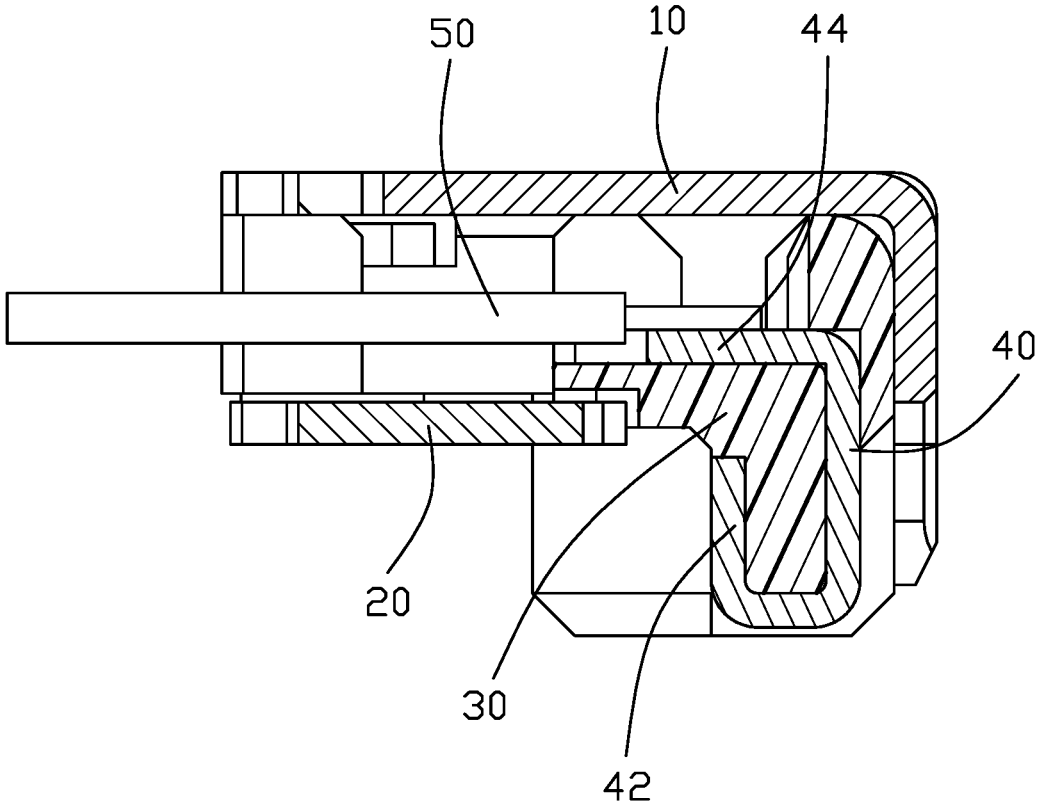
FIG. 7 is another cross-sectional view of the electrical connector to show the relation among the contact, the cable wire, the housing and the shells.

Referring to FIGS. 1-3, an electrical connector 100 includes an elongated insulative housing 30 extending along a longitudinal direction, a plurality of contacts 40 secured to the housing 30, an upper/first shell 10 attached to the housing 30, and a lower/second shell 20 attached to the housing 30 and connected to the upper shell 10. The electrical connector 100 may further include a cable or cable wires 50 linked respectively to the corresponding contacts and extending along a front-to-back direction perpendicular to the longitudinal direction, and located between the upper shell 11 and the lower shell 20 in the vertical direction perpendicular to both the longitudinal direction and the front-to-back direction.

Referring to FIGS. 4-7, the housing 30 has a thickened portion/divider 31 at a middle thereof, and the contacts 40 are arranged in a longitudinal direction at two sides of the thickened portion/divider 31. The thickened portion 31 has a front protrusion 32. The upper shell 10 has a planar main portion 11, a vertical latching piece 12 bent downward from the main portion 11, and a horizontal connecting piece 13 bent from the latching piece to overlay the lower shell 20. The latching piece 12 and the connecting piece 13 commonly forms an L-shaped securing tab (not labeled) for securing to both the housing 30 and the lower shell 20. The latching piece 12 has a hole 120 for receiving the protrusion 32 of the thickened portion 31. The connecting piece 13 has a soldering hole 130 so that solder may be applied in the hole as well as on the lower shell. The lower shell 20 has a planar main portion 21 and a middle protruding piece 22 bent upward from the main portion 21. The protruding piece 22 is received in a hole 33 of the thickened portion 31 for reinforcing securement of the lower shell 20 to the housing 30.

The upper shell 10 further includes a side wall 14 perpendicular to the main portion 11. The side wall 14 has fingers 140 at two ends thereof. Outwardly of the fingers 140 are U-shaped legs 15 each having holes 150 for engaging a mating connector. The housing 30 includes two end portions 34 each having a respective front slot 340. When the upper shell 10 is attached to the housing 30, the fingers 140 interference fit with a wall of the housing and the U-shaped legs 15 are partly received in the slots 340. The end portion 34 has a stand 341 and the lower shell 20 has hooks 23 at two ends thereof for engaging the stands 341.

The contacts 40 are insert molded at a wall 35 of the housing 30. Each contact 40 has a first contacting portion 41, a connecting portion 43, a second contacting portion 42, and a soldering tail 44. The first contacting portion 41, the connecting portion 43, and the second contacting portion 42 form a U-shaped structure and are exposed to an exterior surface of the wall 35. The tail 44 is exposed to another side of the housing 30 for soldering connection to cable wire 50.

The feature of the invention is to provide the securing tab of one of the upper shell and the lower shell around the middle region of the housing 30 for securing to both the housing and the other of the upper shell and the lower shell, thus assuring reliable rigidity of the whole shell assembly including the upper shell and the lower shell. It is noted that the upper shell 10 has the latching piece 12 to secure to the protrusion 32 of the housing, and the connecting section 13 to secure to the lower shell 20 for dual-fixation. Correspondingly, the lower shell 20 has the protruding piece 22 to be secured within the hole 33 of the housing 30, and a middle region to be secured/soldered to the connecting section 13 of the upper shell 10 for dual-fixation too. In other words, either upper shell 10 or the lower shell 20 has its own dual-fixation thereof.

What is claimed is:

1. An electrical connector comprising:

an elongated insulative housing;

a plurality of contacts secured to the housing;

an upper shell attached to the housing, the upper shell having a latching piece secured to a middle portion of the housing; and a lower shell attached to the housing and connected to the upper shell at both end portions thereof in a longitudinal direction, the lower shell having a protruding piece secured to the middle portion of the housing; wherein the upper shell includes a connecting piece bent from the latching piece for securing to a middle portion of the lower shell, and the housing has a protrusion at the middle portion and the latching piece has a hole receiving the protrusion.

2. The electrical connector as claimed in claim 1, wherein the connecting piece overlays a main portion of the lower shell.

3. The electrical connector as claimed in claim 2, wherein the connecting piece has a soldering hole.

4. An electrical connector assembly comprising:

an elongated insulative housing extending in a longitudinal direction and defining a thickened divider at a position along said longitudinal direction;

a plurality of contacts secured in the housing and divided into two groups by two sides of said divider;

a plurality of wires mechanically and electrically connected to the corresponding contacts and extending along a front-to-back direction perpendicular to the longitudinal direction; and a shell assembly including a first metallic shell and a second metallic shell being opposite to each other in a vertical direction perpendicular to both the longitudinal direction and the front-to-back direction, and respectively secured to the housing; wherein said first shell includes a securing tab fastened to both the divider and the second shell around said divider.

5. The electrical connector assembly as claimed in claim 4, wherein said wires are located between the first shell and the second shell in the vertical direction.

6. The electrical connector assembly as claimed in claim 4, wherein the second shell includes a protruding piece received in a hole formed in the divider for securing to the housing.

7. The electrical connector assembly as claimed in claim 4, wherein said securing tab is of an L-shaped configuration having a vertical latching piece to secure to the housing, and a horizontal connecting piece to secure to the other of the first shell and the second shell.

8. The electrical connector assembly as claimed in claim 7, wherein said latching piece has a hole receiving a protrusion formed on the divider.

9. The electrical connector assembly as claimed in claim 7, wherein said connecting piece is soldered to the other.

10. The electrical connector assembly as claimed in claim 7, wherein said second shell forms a protrusion received within a hole formed in the housing, and said protrusion is aligned with and spaced from the securing tab in the front-to-back direction.

11. The electrical connector assembly as claimed in claim 10, wherein said protrusion and said vertical latching piece are spaced from and parallel to each other in the front-to-back direction.

12. The electrical connector assembly as claimed in claim 4, wherein said divider is located around a middle region of the housing.

13. An electrical connector assembly comprising:

an elongated insulative housing extending in a longitudinal direction and defining a thickened divider at a position along said longitudinal direction;

a plurality of contacts secured in the housing and divided into two groups by two sides of said divider;

a plurality of wires mechanically and electrically connected to the corresponding contacts and extending along a front-to-back direction perpendicular to the longitudinal direction; and a shell assembly including a first metallic shell and a second metallic shell being opposite to each other in a vertical direction perpendicular to both the longitudinal direction and the front-to-back direction, and respectively secured to the housing; wherein said first shell has a securing tab secured upon the divider, and the second shell has a protruding piece received within a hole formed in the divider, and said securing tab is of an L-shaped configuration with a vertical latching piece secured to the divider, and a horizontal connecting piece secured to the second shell.

14. The electrical connector assembly as claimed in claim 13, wherein said securing tab and said protruding piece are aligned with and spaced from each other in the front-to-back direction.

15. The electrical connector assembly as claimed in claim 13, wherein said wires extend along the front-to-back direction, and are located between the first shell and the second shell in the vertical direction.

16. The electrical connector assembly as claimed in claim 13, wherein said latching piece forms a hole to receive a corresponding protrusion on the divider.

17. The electrical connector assembly as claimed in claim 16, wherein said connecting piece forms another hole to be solder upon the second shell.

18. The electrical connector assembly as claimed in claim 13, wherein said divider is located around a middle region of the housing.

* * * * *